US010246924B2

(12) United States Patent
Hopkins

(10) Patent No.: US 10,246,924 B2
(45) Date of Patent: Apr. 2, 2019

(54) DOOR ANTI-SLAMMING DEVICE

(71) Applicant: Nicolas Leith Hopkins, Hamilton (NZ)

(72) Inventor: Nicolas Leith Hopkins, Hamilton (NZ)

( * ) Notice: Subject to any disclaimer, the term of this patent is extended or adjusted under 35 U.S.C. 154(b) by 0 days.

(21) Appl. No.: 15/126,832

(22) PCT Filed: Mar. 17, 2015

(86) PCT No.: PCT/NZ2015/000015
§ 371 (c)(1),
(2) Date: Sep. 16, 2016

(87) PCT Pub. No.: WO2015/142187
PCT Pub. Date: Sep. 24, 2015

(65) Prior Publication Data

US 2017/0096850 A1 Apr. 6, 2017

(30) Foreign Application Priority Data

Mar. 17, 2014 (NZ) ..... 622569

(51) Int. Cl.
*E05F 5/06* (2006.01)
*E05F 5/02* (2006.01)
(Continued)

(52) U.S. Cl.
CPC ..... *E05F 5/02* (2013.01); *E05F 5/08* (2013.01); *E05F 5/10* (2013.01)

(58) Field of Classification Search
CPC . Y10T 16/625; Y10T 16/628; Y10T 16/6285; Y10T 16/5383; E05F 3/00;
(Continued)

(56) References Cited

U.S. PATENT DOCUMENTS 1,704,217 A * 3/1929 Rosenthal ..... E05F 5/02 16/82
5,468,042 A 11/1995 Heinrichs et al.
(Continued)

FOREIGN PATENT DOCUMENTS

CN 102996000 A 3/2013
CN 103025987 A 4/2013
(Continued)

OTHER PUBLICATIONS

International Search Report for PCT/NZ2015/000015, dated Sep. 24, 2015.
(Continued)

*Primary Examiner* — Chuck Y Mah
(74) *Attorney, Agent, or Firm* — Amster, Rothstein & Ebenstein LLP

(57) ABSTRACT

A door anti-slamming device, wherein the device includes a chamber with an entrance located at a first end; wherein the chamber houses a plunger component with a tip configured to slidably move in and out of the entrance, therefore defining a compacted configuration and an extended configuration of the device, respectively; wherein the device includes an biasing means configured to bias the device towards the extended configuration; wherein the device includes a first cavity and a second cavity located within the chamber and/or plunger component, and wherein a partition is located between the first and second cavity characterised in that the partition includes an orifice configured to control material transfer rate between the first cavity and second cavity, wherein the device is configured to transition to the compacted configuration at a rate controlled by the material transfer from the first cavity into the second cavity.

17 Claims, 6 Drawing Sheets

(51) Int. Cl.
*E05F 5/08* (2006.01)
*E05F 5/10* (2006.01)

(58) Field of Classification Search
CPC ..... E05F 3/10; E05F 3/14; E05F 3/16; E05F 3/18; E05F 3/20; E05F 3/102; E05F 5/00; E05F 5/003; E05F 5/02; E05F 5/06; E05F 5/006; E05F 5/08; E05F 5/10; E05F 5/022; E05Y 2900/54; E05Y 2900/548; E05Y 2201/21; E05Y 2201/254; E05Y 2201/256; E05Y 2201/264; E05Y 2201/266; E05Y 2201/412; E05Y 2600/456; E05Y 2900/20
See application file for complete search history.

(56) References Cited

U.S. PATENT DOCUMENTS

| | | | | |
|---|---|---|---|---|
| 6,615,450 | B2 * | 9/2003 | Salice | E05F 5/02 16/85 |
| 7,845,050 | B2 * | 12/2010 | Pyo | E05F 5/02 16/82 |
| 2003/0213663 | A1 * | 11/2003 | Salice | E05F 5/08 188/284 |
| 2004/0112694 | A1 | 6/2004 | Spicer et al. | |
| 2004/0150143 | A1 * | 8/2004 | Zimmer | E05F 5/02 267/64.11 |
| 2004/0231099 | A1 * | 11/2004 | Li | E05F 5/02 16/85 |
| 2006/0207843 | A1 * | 9/2006 | Migli | E05F 5/02 188/282.1 |
| 2007/0251052 | A1 * | 11/2007 | Pyo | E05F 5/02 16/86 A |
| 2007/0271732 | A1 * | 11/2007 | Bantle | E05F 5/02 16/84 |
| 2008/0245630 | A1 | 10/2008 | Le | |
| 2009/0090587 | A1 * | 4/2009 | Tomita | F16F 9/5126 188/282.6 |
| 2009/0094789 | A1 * | 4/2009 | Bereznai | E05F 5/10 16/84 |
| 2009/0119873 | A1 * | 5/2009 | Bassi | E05F 5/08 16/84 |
| 2010/0170062 | A1 * | 7/2010 | Kim | E05F 5/10 16/52 |
| 2010/0212109 | A1 * | 8/2010 | Kim | E05F 5/006 16/85 |
| 2011/0088214 | A1 * | 4/2011 | Lange | E05C 17/305 16/63 |
| 2011/0253493 | A1 * | 10/2011 | Svara | F16F 9/0218 188/313 |
| 2012/0110914 | A1 * | 5/2012 | Salice | F16F 9/19 49/386 |
| 2013/0061425 | A1 | 3/2013 | Inaguchi | |
| 2013/0145580 | A1 | 6/2013 | Brunnmayr | |
| 2013/0145696 | A1 | 6/2013 | Wach et al. | |
| 2013/0160242 | A1 | 6/2013 | Brunnmayr | |
| 2013/0255033 | A1 * | 10/2013 | Vu | E05F 5/06 16/82 |

FOREIGN PATENT DOCUMENTS

| | | | |
|---|---|---|---|
| CN | 103069093 | A | 4/2013 |
| DE | 528780 | C | 7/1931 |
| DE | 202006011846 | U1 | 1/2008 |
| GB | 2498747 | A | 7/2013 |
| JP | S59-21382 | U | 2/1984 |
| KR | 20100100297 | A | 9/2010 |
| WO | 2009/031723 | A1 | 3/2009 |

OTHER PUBLICATIONS

Written Opinion of the International Searching Authority for PCT/NZ2015/000015, dated Sep. 24, 2015.

European Patent Office, "Extended European Search Report," issued in European Patent Application No. 15 764 858.5, which is a European counterpart of U.S. Appl. No. 15/126,832, dated Nov. 15, 2017, 7 pages.

Australian Government IP Australia, "Examination Report," issued in Australian Patent Application No. 2015232045, which is a Australian counterpart of U.S. Appl. No. 15/126,832, dated Sep. 5, 2018, 5 pages.

Intellectual Property Office New Zealand, "First Examination Report," issued in New Zealand Patent Application No. 622569, which is a New Zealand Patent counterpart of U.S. Appl. No. 15/126,832, dated Mar. 25, 2014, 2 pages.

Intellectual Property Office New Zealand, "Further Examination Report," issued in New Zealand Patent Application No. 622569, which is a New Zealand Patent counterpart of U.S. Appl. No. 15/126,832, dated Sep. 24, 2014, 2 pages.

Intellectual Property Office New Zealand, "Further Examination Report," issued in New Zealand Patent Application No. 622569, which is a New Zealand Patent counterpart of U.S. Appl. No. 15/126,832, dated Dec. 12, 2014, 2 pages.

* cited by examiner

DOOR ANTI-SLAMMING DEVICE

TECHNICAL FIELD

This invention relates to a door anti-slamming device and its method of use.

BACKGROUND ART

There is a wide variety of industries and devices that could benefit from door anti-slamming devices. This is from a safety perspective to avoid injury from doors unexpectantly slamming, as well as comfort perspective and avoidance of damage to doors or the surrounding structures.

For example, shipping container doors are very heavy and large. At sea, or even at port, wind can catch a door and quickly cause it to slam against the container walls or entrance, even if a person or safety mechanism is intended to temporarily hold it in place. This may be particularly applicable during inspection of the containers during customs duty which often occurs at sea, or at the time of loading or unloading. If a person is inadvertently in the path of the door as it slams against a surface, the person could be severely injured.

The same applies to other situations, one being the common internal door in a house, or an exterior door. One can readily recall situations where a wind channel forms through a house (due to two external doors/windows being open) which can cause one of the doors to often violently slam shut, where the momentum of the door will build as it slams shut. The same applies to when children are playing with a door, and decide to slam the door without thinking of the potential consequences.

Primarily this is a safety concern as children (or adults, for that matter) may have a hand or fingers inside the door frame. This can lead to injury, or in severe cases broken bones or even complete amputation of finger(s).

Secondly, even if no one is near the door and therefore injury is not a concern, a slamming door can still cause damage to the door or door frame, especially if it happens many times or if there is an extreme force applied. A slamming door can also be a rather horrible noise to hear, and most people would want to avoid the situation where possible.

There are anti-door slamming devices already on the market but these can have a number of problems as outlined below.

- Many devices can be overly big, cumbersome and/or unsightly due to their requirement to house large components or the need to be positioned in a particular area to achieve the desired function.
- Many door anti-slamming devices which are configured to withstand more extreme forces being applied can also be overly expensive due to large componentry or systems.
- Yet other smaller devices can be simply inadequate to handle more extreme forces. For example, devices which primarily rely on a biasing means such as a spring to slow a slamming door do not work well.
- Many current devices can be overly complicated from a mechanical perspective, and be prone to damage or faulty parts.
- Often the intended impact point of the device is disadvantageously configured to slow a very fast moving peripheral part of the pivoting door.

- Many types of door anti-slamming devices can be frustrating to use as the systems employed can prevent a person from easily closing the door at a normal speed.
- Many door anti-slamming devices are not able to be easily adjustable to suit the needs of the user, or changing conditions.
- There is a need to provide simple, cost effective devices that can be used across a wide variety of industries primarily as a safety measure, and there is a particular need to address this in the shipping container industry, within households and in other applications such as vehicle doors or smaller objects such as tool box doors.

It is an object of the present invention to address the foregoing problems or at least to provide the public with a useful choice.

All references, including any patents or patent applications cited in this specification, are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

Further aspects and advantages of the present invention will become apparent from the ensuing description which is given by way of example only.

DISCLOSURE OF THE INVENTION

According to one aspect of the present invention there is provided a door anti-slamming device to be housed substantially within a wall cavity or a door cavity, wherein the device includes a chamber with an entrance located at a first end;

wherein the chamber houses a plunger component with a tip configured to slidably move in and out of the entrance, therefore defining a compacted configuration and an extended configuration of the device, respectively;

wherein the device includes an biasing means configured to bias the device towards the extended configuration;

wherein the device includes a first cavity and a second cavity located within the chamber and/or plunger component, and wherein a partition is located between the first and second cavity characterised in that the partition includes an orifice configured to control material transfer rate between the first cavity and second cavity, wherein the device is configured to transition to the compacted configuration at a rate controlled by the material transfer from the first cavity into the second cavity.

According to another aspect of the present invention there is provided a replaceable plunger component configured to be inserted within the device substantially described herein.

According to another aspect of the present invention there is a method of using a door anti-slamming device as substantially herein described.

Brief Outline of the Advantages of the Present Invention

As will become clearer with the ensuing description, some of the overriding advantages of the present invention are the reliability, control and strength of the device considering its preferred overall compactness in size and intended positioning for use.

The inventive mechanism effectively prevents doors slamming and therefore is a significant improvement over current devices which are either unsightly or do not function efficiently and therefore still represent a safety hazard.

Also, as will be elaborated on further, the mechanism may be easily adapted for different uses or conditions.

Preferred Embodiments and Definitions of Integers

First, it should be made clear, as discussed throughout this specification, that the device may be configured in a wide number of ways as is exemplified in the Best Modes and Figures of the present application. In particular, the particular configuration and interworking relationship of the plunger, biasing means, first cavity and second cavity of the chamber and the partition housing the orifice may vary substantially yet still provide desired effects and benefits.

Therefore, the present invention should not be restricted in anyway to the examples or preferred embodiments provided, and someone skilled in the art would appreciate many alternative configurations would still encompass the spirit of the invention and its advantages.

Device

The anti-door slamming device typically will have a cylindrically shaped outer body. Although substantially any shape may be used, this preferred shape may allow it to be easily installed to more easily into a door or wall cavity for instance after using a drill to make a cylindrically shaped cavity in the door or wall cavity.

Also, the inventor envisages that the device may include a face plate at the entrance to the device, typically with at least a few screw holes. This may allow the installer to fix the device securely such the face plate sits flush with the wall or door surface, with only the tip of the plunger protruding from the wall or door surface.

Preferably the device is configured to be positioned inside an internal door frame.

For instance, the device may be either integrally built into a hinge, or installed close to a hinge.

Preferably, an impact plate may be positioned on a portion of the door at a point where the tip of the plunger will impact when the door is closed. It should be appreciated that the device could alternatively be placed within the door cavity, and the impact plate may then be placed on the opposition position on the door frame wall.

The use of an impact plate may help to protect the door/wall from damage, and may help to ensure the device continues to work consistently. If there was no impact plate, it is possible that the tip may drive through the opposing surface either from repeated use, or from a single occurrence under extreme conditions, such that the device could potentially fail.

It should be appreciated that when the door closes, the force and speed of the door closing (e.g. due to wind or being slammed by a child) may be stopped prior to the door shutting, or at least the force and speed of the door will be substantially decreased prior to shutting. Depending on the application, the device may be configured to do either. In this way, the present invention will help to prevent severe injury to a person (such as to their fingers).

The device may be made of substantially any material although for strength and durability the inventor intends to use stainless steel for the majority of its components.

Chamber

Throughout this specification the term chamber should be understood to mean the internal space within the device. In the context of a cylindrically shaped device, the chamber may equivalently be a cylindrically shaped chamber which is substantially closed apart from the entrance.

The chamber houses the plunger which is configured to slidably move within it as outlined further below.

Entrance

The entrance provides access for the plunger to be installed. For instance, this may be applicable when the plungers are configured to be replaceable such that the user does not need to also replace the chamber.

Also the entrance allows the tip of the plunger to move in and out of the chamber to allow the device to move between a compacted and expanded configuration. As will be outlined below, if no inward force is applied to the tip (typically from force from the door bearing against the tip), the plunger will be biased outwards from the chamber towards with the tip protruding out of the entrance which defines the extended configuration.

Preferably the entrance includes a stop.

The stop may be configured as an internal lip to prevent the plunger and/or its tip to extend out of the chamber passed a pre-defined position.

Typically, the device will be configured such that in the extended configuration, the tip extends out of the entrance by about 18 mm. Obviously, the size and shape of the tip may vary depending on the application.

Plunger

Throughout this specification the term plunger should be taken as meaning a component of the device that slidably moves in and out of the chamber to allow the device to move between the two configurations.

Preferably, upon a force being applied to the tip, movement of the plunger into the chamber applies a pressure to the first cavity resulting in material transfer from the first cavity to the second cavity at a controlled material transfer rate through the orifice, whereby once material has substantially transferred to the second cavity, the device is in the compacted configuration.

Preferably, once a force is removed from the tip, the biasing means is configured to draw material back from the second cavity into the first cavity to return the device to the extended configuration.

To exemplify the present invention, the preferred embodiments of the plunger are now discussed in relation to other components of the device and there interworking relationships (each component in turn will also be elaborated on further in this specification).

General Embodiment 1

According to embodiment 1 (as exemplified by Example 1 and FIGS. 2A-B to 4A-B) the following embodiments are envisaged:

- the plunger is configured to house the second cavity;
- the plunger is configured to house the biasing means;
- the second cavity is formed by internal side walls of the plunger, the partition which to includes the orifice, and a movable wall;
- the movable wall is biased towards the partition through engagement with the biasing means, but will retract therefrom to expand the size of the second cavity upon pressure build up as a result of material passing through the orifice.

In embodiment 1, as expansion of the second cavity occurs, the material in the first cavity (preferably in the remaining part of the chamber) is transferred into the second cavity via the orifice, providing room for the plunger to slide into the chamber as a result of force being applied to the tip.

Embodiment 1 provides considerable advantages as all the substantial components are provided within the plunger component. This may be particularly advantageous when the plunger is configured to be replaceable or needs to be repaired.

Embodiment 1 may also be more applicable for less extreme conditions or in dealing with smaller doors with less force being imposed onto the plunger for example, on car doors, house doors or even small appliances such as a tool box. This lesser force allows the plunger to be of adequate strength yet still house the biasing means and the movable wall as well as the partition housing the orifice.

In this embodiment, to avoid material leakage from the first cavity when the plunger is removed, the plunger may be configured to draw out substantially all the material into the second cavity before the plunger is dispatched and/or replaced.

General Embodiment 2

In embodiment 2 (as exemplified in Example 2 and FIGS. 5A and B) the following embodiments are envisaged:

- the second cavity is formed from an interworking relationship between the plunger configured as a centralized column, the inner walls of the chamber, the partition including the orifice and a movable wall which slides about the centralized plunger and against the inner walls of the chamber.
- the biasing means is in the first cavity as is biased towards the first cavity being expanded.
- The first cavity is located in the peripheral portion of the chamber distal to the entrance.
- As the plunger is forced into the chamber, the material transfers through the orifice, driving back the movable wall to expand the size of the second cavity to accommodate the displaced material from the first cavity.

The configuration of embodiment 2 may be advantageous as substantially all of other components are not being housed internally within the plunger. In this way, the plunger may be less prone to damage, especially under more considerable force or extreme conditions. This reflects that the plunger may be constructed of more solid components (having a centralized column) on the basis it does need to house the biasing means, an internally constructed movable wall, or even the partition with the orifice.

Additionally, in this configuration the plunger may be removed, replaced or repaired whilst material is retained in the first cavity.

General Embodiment 3

In embodiment 3 (as exemplified in Example 3 and FIGS. 6A and B) the following embodiments are envisaged:

- The partition is a fixed wall integrally built into the chamber, with the partition including the orifice.
- The second cavity is located on the opposite side to the partition away from the entrance.
- The second cavity is defined by the inner walls of the chamber, the partition and a movable wall biased towards the partition by the biasing means.
- The first cavity is located on the opposite side of the partition to the second cavity nearer to the entrance, and is defined by the inner walls of the chamber, the partition housing the orifice and by the front surface of the plunger.
- The plunger may simply be a solid cylindrical component that drives into the first cavity.

Features of this embodiment again may be particularly beneficial for more extreme applications, for example on shipping containers where heavy doors and extreme wind conditions are evident. In this embodiment, the plunger, the built in partition and orifice, and/or the movable wall/biasing means may be particularly configured to handle more extreme forces and/or repetitive usage.

The special features of embodiment 3 wherein the partition is built in to the chamber, and wherein the biasing means is retained separate to the material communication may help to ensure the device is more robust.

It should be appreciated that aspects of any one of embodiments 1-3 may be intermixed to provide even more embodiments which fall within the scope of the invention, and provide particular advantages.

Tip

The tip of the plunger may be substantially any shape or configuration without departing from the scope of the invention.

Typically, the tip will have a substantially curved end as this will be the surface which contacts an opposing surface upon impact.

The tip may have a diameter of about 12 mm, and a length of about 18 mm. These measurements have been found to be well suited to the present invention as they are not overly obtrusive yet equally are able to sufficiently slow or stop a slamming door.

Also, because of the clever preferred positioning of the device within the internal door frame (next to the door hinge), the tip may make contact with the opposing surface well before the door is closed without the need for the tip to protrude outwardly in any excessive level.

Compacted Configuration and Extended Configuration

It should be appreciated that the configuration of the device moving between the compacted and extended configuration may merely be a result of the tip moving out of or into the chamber through the entrance.

Biasing Means

It is possible that a wide type of biasing means may be used to bias the device towards the extended portion, and such embodiments should be considered within the scope of the invention.

It should be appreciated that the biasing means is not intended to act as the counter-force against a slamming door like many of the prior art devices. Instead, the biasing means is intended only to permit the device to return easily to the extended configuration after a force (slamming door) has been removed.

Preferably the biasing means is a spring-loaded coil.

It is has been exemplified already that the biasing means may be configured to interwork together with different components of the device.

For example, the biasing means may be located inside the plunger and be engaged with a movable wall (as in Embodiment 1), or inside the first cavity and engaged with the partition which is movable (as in Embodiment 2) or even inside a specially adapted region which is not in communication with the fluid which is able to transfer between the first and second cavity (as in Embodiment 3).

However, it should be appreciate that in all embodiments, the biasing means is configured to favour the expanded configuration, and in all embodiments it does this by expanding the size of the first cavity in the expanded configuration, as outlined below.

First Cavity

Throughout this specification, the term first cavity should be taken as meaning an area of the plunger and/or chamber that forms a substantially closed area apart from the orifice which provides material communication between the first cavity and the second cavity.

The first cavity should also be taken as meaning the cavity that, when the device is in the expanded configuration, a material will be biased into. This may typically through action of the biasing means.

To exemplify this, in Embodiments 1 and 2, the first cavity may be located at the distal end of the chamber away from the entrance, whereas in Embodiment 3, the first cavity is located between the plunger and the partition, much closer to the entrance of the chamber.

It should also be appreciated that the first cavity may be configured as a result of interworking relationships from different components of the device. For example, the internal walls of the chamber may act not only to retain the plunger and keep the device secure, but also may act as at least one portion of the first (or second) cavity. These interworking relationships are very inventive ways of utilising at least one component of the device for more than one function, which helps avoid unnecessary components to reduce manufacturing costs.

Preferably, the first cavity is configured to expand and contract.

This embodiment allows the first cavity to accommodate an increased volume of material when the device is in the expanded configuration. It then also allows the first cavity to compact when less volume of material is present in the first cavity, and this typically will provide the necessary space for the plunger and tip to slidably compact into the chamber to provide the compacted configuration of the device.

Second Cavity

Throughout this specification, the term second cavity should be taken as meaning an area of the plunger and/or chamber that forms a substantially closed area apart from the orifice which provides material communication between the first cavity and the second cavity.

The second cavity should also be taken as meaning the cavity that, when the device is in the expanded configuration, a material will be biased out of. Again, typically this biasing is through action of the biasing means.

Similar to the first cavity, it should also be appreciated that the second cavity may be configured as a result of interworking relationships from different components of the device. This is exemplified in Embodiments 1 to 3 above, and one skilled in the art would appreciate other to similar options that fall within the scope of the invention.

Preferably, the second cavity is configured to expand and contract.

This embodiment allows the second cavity to accommodate an increased volume of material when the device is in the compacted configuration. It then also allows the second cavity to contract when less or no volume of material is present in the second cavity, as typically will be the case when the device is in the expanded configuration.

Preferably, the expanded volume of the second cavity is substantial equal to the expanded volume of the first cavity.

In this way, the displaced material which is transferred from say, the first cavity to the second cavity, is able to be retained.

Partition

Throughout the specification the term partition should be taken as meaning a barrier or division that is used to separate the first and second cavity and prevent uncontrolled material transfer between the two cavities.

Preferably, the partition is substantially non-permeable to any material located in the first and/or second cavity. For instance, the partition may be made substantially of plastic resin or stainless steel.

Preferably, the partition is slidably movable relative to the chamber of the device.

This embodiment is advantageous in embodiments such as Embodiments 1 and 2, where the partition forms part of the second cavity and allows the second cavity to expand to accommodate the material as it is transferred through the orifice.

Alternatively, the partition is in a fixed position relative to the chamber of the device.

In this embodiment, the partition may be integrally formed as part of the chamber, as exemplified in Embodiment 3.

As discussed previously, this may be preferred if more strength is required and more extreme forces are at play, for instance on container ship doors.

Material and Material Transfer

Throughout the specification the term material should be taken as meaning a substance which is able to be transferable through an orifice.

Preferably, the device includes the material.

It should be appreciated that the device may be manufactured and sold without the material, and then prior to use, the material is added to allow it to be effectively used.

Preferably the material is a liquid.

The liquid may be selected from options such as water, oil, detergent gel, etc.

The use of oil or detergent has a number of advantages. It may be used to help lubricate components of the chamber. Also the added viscosity may help to control (in combination with the configuration of the orifice) the material transfer rate through the orifice and hence the compaction speed of the device.

The clever use of a fluid in combination (and interworking relationship with the other components of the device) means that the compression and extension process may be able to be accurately controlled primarily through the configuration of the orifice.

The inventor trialed the current invention for considerable time using air, and found this not to be overly effective as air is compressible. The fact that air is compressible means that the control of the slamming process is not able to be controlled solely by the size and shape of the orifice (discussed below). Instead, the air in either the first and/or second cavity could compress, leading to a less accurate compression process. Ultimately, this translated into less accurate control of door slamming, which was found to be ineffective especially under extreme forces.

In saying this, air may be present in some parts of the chamber, as elaborated below.

Orifice

Throughout this specification, the term orifice should be taken as meaning a path, channel, hole, aperture or pore which allows a controlled transfer rate of material through the partition between the first cavity and second cavity of the device.

The orifice is a key feature of the invention which is central across all embodiments, and helps to provide many of the beneficial advantages seen from the concept.

The orifice acts as the "gatekeeper" or "bottleneck" and works in an elaborate interworking relationship with the other components to allow close control of the contraction and expansion process of the device. The orifice may be easily configured to then provide a clever way of controlling the compaction process and allowing different embodiments to suit particular uses, conditions and so forth.

Preferably, the orifice is configured as a channel.

In this way, the orifice is simply a channel formed in the partition.

It should be appreciated that the configuration of the orifice may be configured in a wide number of ways to control flow rate of the material transfer according to the present invention.

Preferably, the channel is between 0.01 mm and 50 mm in diameter.

After careful experimentation, the inventor surprisingly found that retaining the channel diameter between this range provided then necessary resistance to slow or stop a slamming door under the majority of expected conditions or forces.

Yet, another significant advantage of the concept is that when one closes a door at a normal speed, the person should not be able to "feel" the resistance. This is because the flow of the material through the orifice may be configured to transfer at a rate that substantially no bounce back effect is felt.

For instance, an diameter of about 1-10 mm may be more applicable to moderate conditions (for instance on a tool box, car door or house door) and a smaller diameter of about 0.01 to 0.1 mm may be more applicable to situations where the intention is to completely prevent the door from closing, and allow the door to bounce back after absorbing some of the shock of the slamming door.

In larger versions of the device, larger diameters of 50 mm may be used to accommodate more substantial forces and door sizes, such as those seen in shipping containers or perphaps train carriages.

It should also be appreciated that the diameter of the orifice may be matched with other elements of the device to achieve the desired function. For instance, with shipping containers, it may be appropriate to increase the length of the tip (and therefore distance the tip travels as it compacts into the chamber), increase the potential sizes of the first and second cavity, increase the amount of material used, use more viscous fluid as the material, and/or adjust the size of the orifice.

One may appreciate that this may help to cushion and prevent a slamming door of larger size and weight and one which is travelling with a greater force. The same concepts may be used to configure the device for a wide variety of uses and conditions.

Preferably, the orifice includes a nozzle.

The nozzle may be a separate component that fits into the partition, and then which essentially acts as the orifice allowing transfer of material. This may help to more accurately control flow rate of the material and prevent the orifice from damage.

The nozzle's configuration may also provide one way of adjusting the orifice diameter, as discussed below.

The nozzle may be made of any solid material, and most likely of plastic or metal.

Preferably, the diameter of the orifice is adjustable.

This feature may allow someone to adjust the device to allow it to provide greater or less resistance during a door slamming process.

The inventor envisages that an external dial may allow the user to manually adjust the orifice dimensions. Of course, automated options are envisaged as well.

Alternatively, it may be an option, as per Embodiment 1, that one may replace a component in the device that harbours the orifice. This may be a different way for the user or installer to adapt the orifice dimensions.

Preferably, only one orifice is present on the partition.

However, it should be appreciated that multiple orifices may easily be used and achieve a similar function. Also, it is not beyond the present invention to use pores (e.g. microscopic pores) that are dispersed throughout the partition and used to control the flow rate of the material across the partition.

Other Preferred Embodiments

Additional Cavities or Air Pockets

As exemplified in Embodiment 1, an additional cavity may be present in the device. In Embodiment 1, this additional cavity is in the plunger and houses the biasing means. This cavity may be a partial vacuum or contain air. Yet, this additional cavity is not being acted on directly from external forces, so the air pocket is not affecting the compaction rate.

Adjustment Means

Preferably, the device is configured to be adjustable.

For example, there may be considerable advantages in being able to adjust the diameter or size of the orifice. One would then be able to adjust when required the resistance of the device to the desired requirements. A mechanism may be included to allow the user to adjust the orifice size, for example using a dial on the face plate.

Also, there may be considerable advantages in being able to adjust other aspects such as the spring length of the biasing means, or the rate of plunger return, which may also be at least partly attributed to the biasing means. The examples illustrate the use of a key key which may be inserted down the length of the plunger to allow manipulation of the biasing means.

Clearly other adjustment features are envisioned and should not be considered beyond the scope of the invention.

Seals

Preferably, the device includes a plurality of seals to allow the material to be effectively retained within the first and second cavities.

Preferably, the seal is an O-ring.

Preferably, an O-ring is present any components of the device that are movable and are configured to form part of the first or second cavity. Various O-rings are depicted in FIGS. 2A-B to 6A-B which illustrate this embodiment.

Method of Installation and Adaptation

Preferably the device is installed by:

Drilling a suitably shaped cavity in a door frame.

Placing the chamber of the device into the cavity such that the entrance of the chamber substantially sits flush with the door frame, and that the tip protrudes out from the door frame at the desired length.

Fastening the device to the door frame using a plurality of fasteners.

Preferably the device may be adapted or maintained using the following steps:

Replacing either the entire device or just a component thereof (such as a plunger/partition/orifice/biasing means combination) as exemplified in Example 1.

Adjusting the orifice dimensions using a suitable tool or adjustment means (a wide variety of options could be used here to implement this feature).

SUMMARY OF THE ADVANTAGES OF THE PRESENT INVENTION AND ITS USE

- Wide number of applications such as for house doors, car doors, shipping container doors etc.
- Effectively avoids fingers or other body parts getting slammed
- Avoids damage to doors and or door frames
- Doors can be easily retrofitted with the device
- Components of the device may be easily replaced or fixed
- A key feature of the orifice interworking with other components of the device allows effective control of the compaction process of the device, and therefore control of a door to avoid slamming.
- In particular, the size of the orifice may be simply used to dictate the actual compaction process.
- Additionally, increasing the tip's length, amount of material and/or size of the first or second cavity also allows ability to provide greater level of resistance of the device.
- The use of fluid as the material offers significant advantages over other material such as to air.
- The components of the device and also the preferred positioning of the device means that a person should not be able to "feel" any resistance, or at least should not require any substantial effort, when closing the door at a normal speed.
- The ability to configure the orifice to be adjustable enables a user to adjust the device to account for changing conditions.
- No complicated mechanical parts meaning lower manufacturing costs and less likely to require maintenance or repair.
- Easy to install.
- Visually appealing compared to prior art and can be positioned in a discrete place of a door frame compared to the prior art devices.
- The device may be configured to be small and compact, yet the mechanism still is able to provide sufficient counter-force against a slamming door compared to prior art.

BRIEF DESCRIPTION OF THE DRAWINGS

Further aspects of the present invention will become apparent from the ensuing description which is given by way of example only and with reference to the accompanying drawings in which.

BEST MODES FOR CARRYING OUT THE INVENTION

Figure 1:
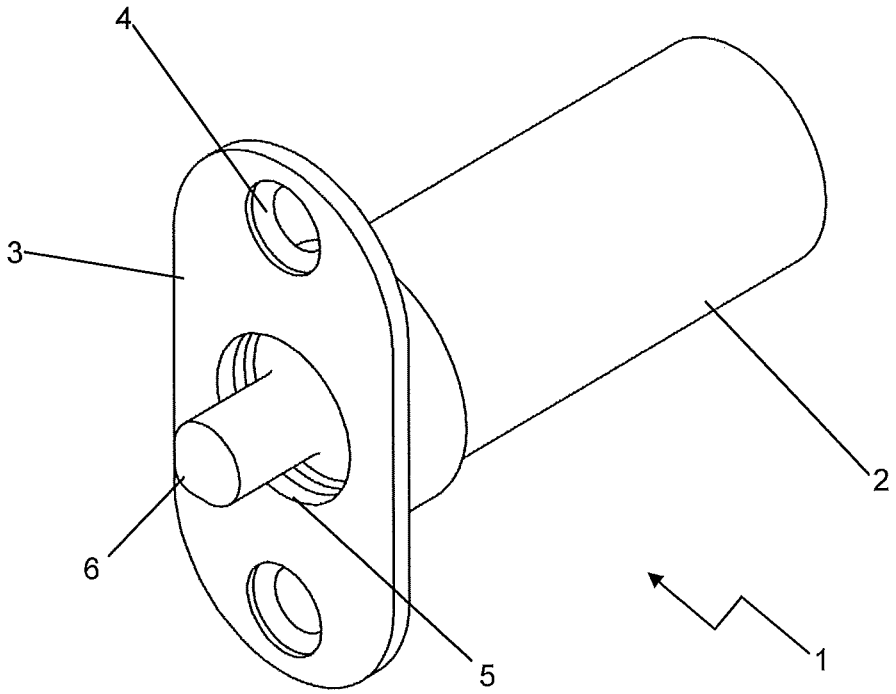
FIG. 1 The exterior views of the door anti-slamming device according to one aspect of the present invention FIG. 2 Cross-sectional view of the door anti-slamming device according to Embodiment 1 of the present invention.

FIG. 1 shows the door anti-slamming device shown generally as (1). The exterior of the device (1) shows cylindrically shaped outer body (2), and the face plate (3) with two screw holes (4). FIG. 1 also illustrates the entrance (5) of the chamber (not shown), with the tip (6) protruding out of the entrance (5), defining the extended configuration of the device (1). The entrance (5) includes an integrally built in retaining ring to prevent the tip (6) from extending past a certain point.

Although not shown, the outer body (2) of the device (1) is intended to be inserted into a cavity of a door frame such that the face plate (3) sits flush with the surface of the door frame.

Although not shown, an impact plate may be positioned on an opposing surface at a position where the tip will contact the impact plate on the slamming door.

To give context to the approximate size of the device, the device normally will be about 80 mm to 120 mm from the entrance to back of the chamber, and the chamber will be about 25 to 40 mm in diameter. The overall size and shape of the device, and components therein may be adapted to suit particular conditions and needs without departing from the scope of the invention.

EXAMPLE 1

Figure 2A:
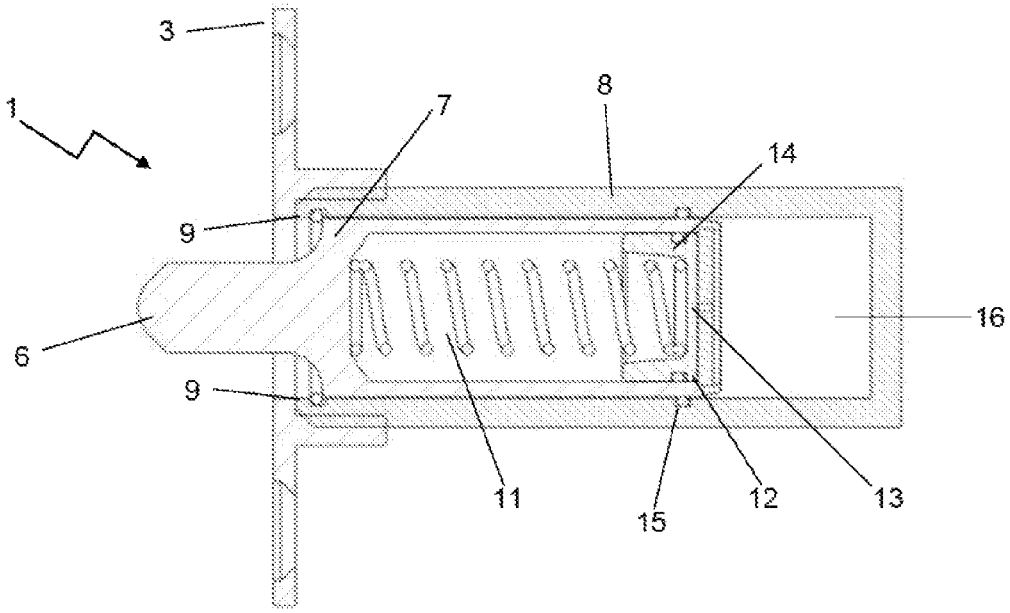
Figure 2B:
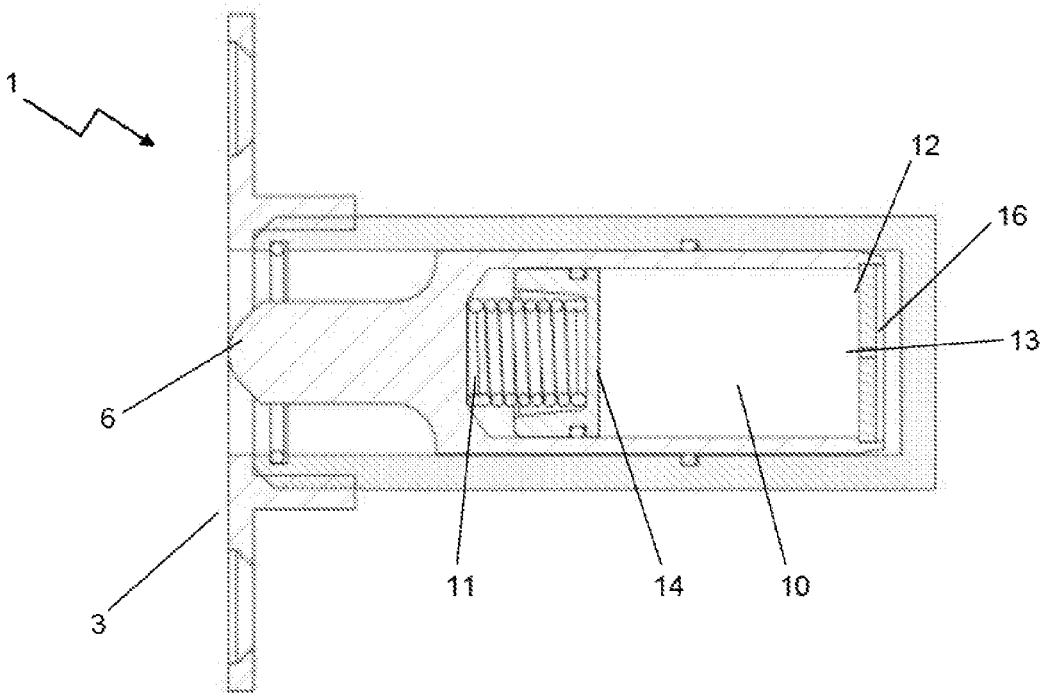

FIGS. 2A and 2B illustrates the device according the Embodiment 1 of the present invention.

The device (1) includes a plunger (7) which is configured to slidably move in the chamber (8) which is also cylindrically shaped. The entrance (5) includes a stop (9). The tip (6) of the plunger (7) protrudes out of the entrance (5) by 18 mm.

The plunger (7) includes the second cavity (10) and biasing means configured as a spring loaded coil (11). The second cavity (10) is formed by the internal walls of the plunger (7), a partition (12) including the orifice (13), and a movable wall (14) which is engaged with the spring loaded coil (11). The plunger (7) and walls of the chamber (8) include O-rings (15) to effectively seal different parts of the device (1).

The chamber (8) includes a first cavity (16) which is expanded when the device is in the expanded configuration, as depicted in FIG. 2A. In this configuration, the second cavity (10) is contracted. Moving to FIG. 2B, the first cavity (16) becomes contracted, and the second cavity (10) becomes expanded as a fluid material (not shown) transfers through the orifice (13) between the cavities.

Figure 3A:
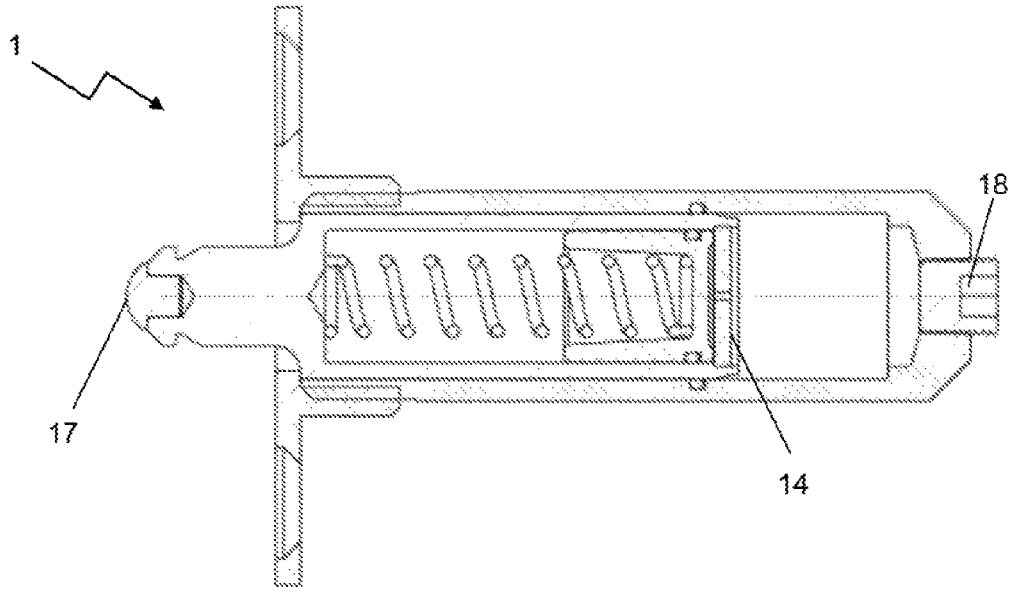
FIG. 3 Cross-sectional view of the an alternative version of door anti-slamming device according to Embodiment 1 of the present invention.
Figure 3B:
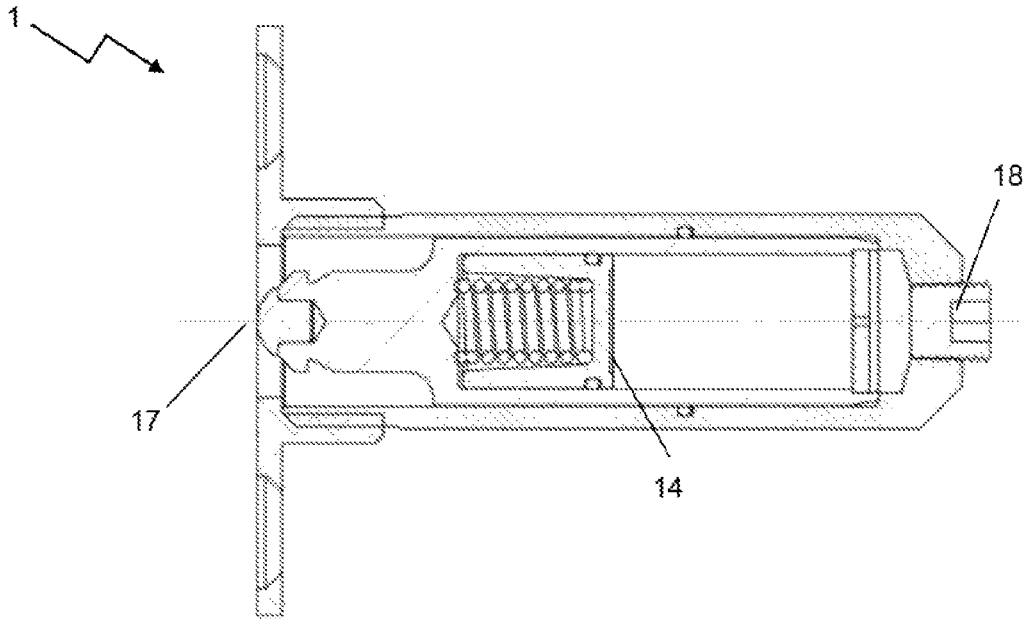

FIGS. 3A and 3B illustrates additional features to that seen in FIGS. 2A and 2B. The tip (6) includes a cap (17). The cylindrical outer body includes a pressure plug (18).

Figure 4A:
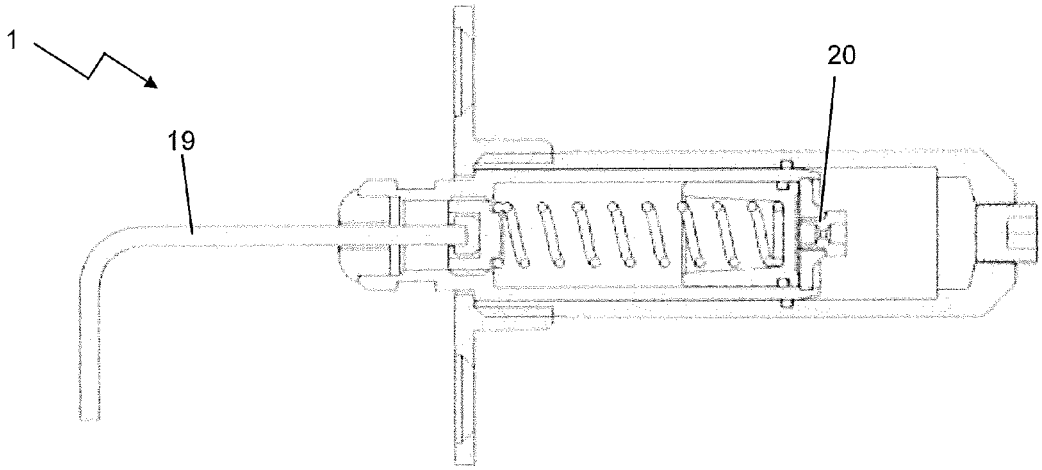
FIG. 4 Cross-sectional view of the a further alternative version of door anti-slamming device according to Embodiment 1 of the present invention.
Figure 4B:
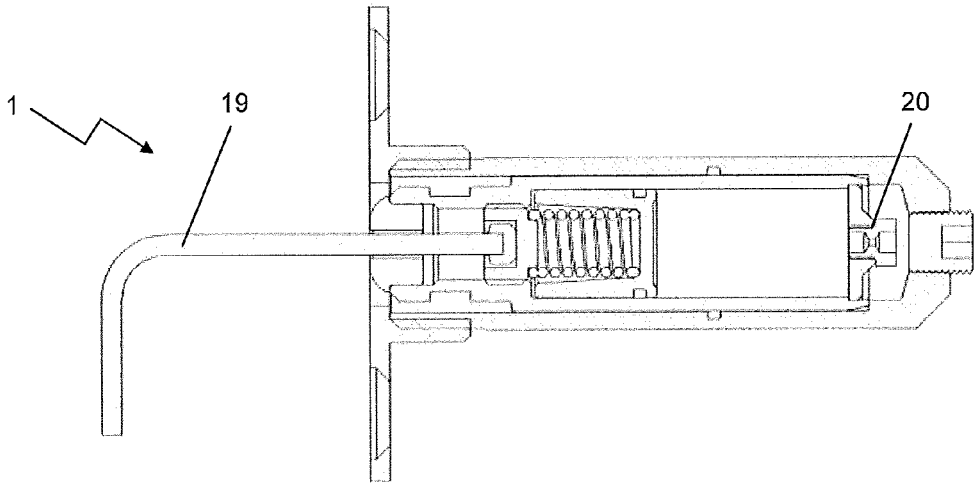

FIGS. 4A and 4B illustrate further features to those seen in FIGS. 2A and 2B and FIGS. 3A and 3B. The tip (6) includes a path configured to allow access to a hex key (19). The orifice (13) includes a nozzle (20) with a defined pathway through the nozzle (20).

EXAMPLE 2

Figure 5A:
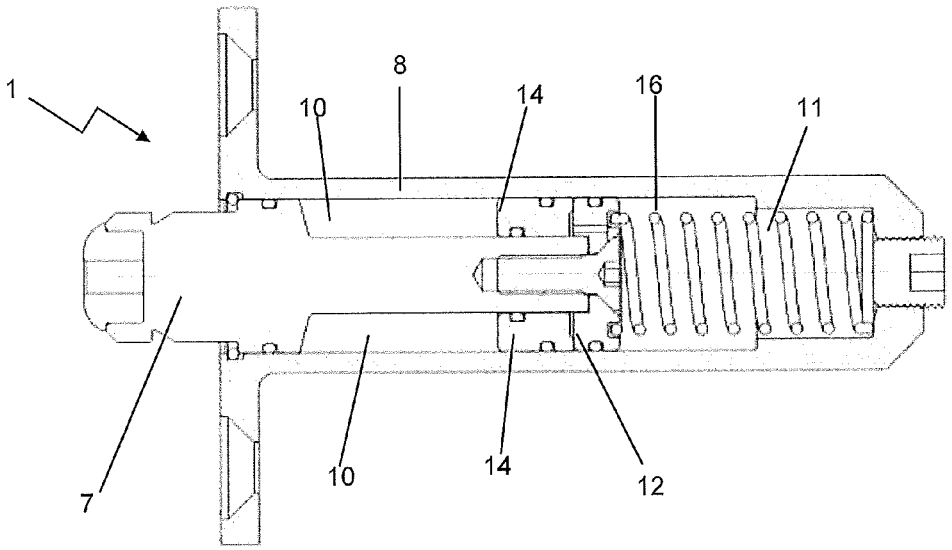
FIG. 5 Cross-sectional view of the door anti-slamming device according to Embodiment 2 of the present invention, and FIG. 6 Cross-sectional view of the door anti-slamming device according to Embodiment 3 of the present invention.
Figure 5B:
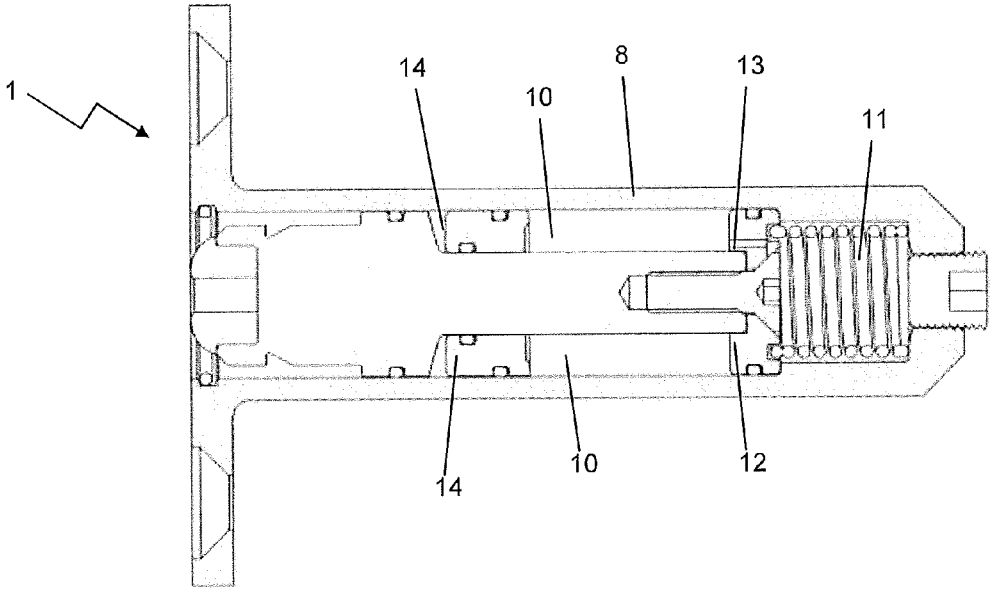

FIGS. 5A and B illustrate the device according the Embodiment 2 of the present invention in an expanded configuration and compacted configuration, respectively.

In Embodiment 2, the second cavity (10) is formed from an interworking relationship between the plunger (7) configured as a centralized column, the inner walls of the chamber (8), the partition (12) including the orifice (13) and a movable wall (14) which slides about the centralized plunger (7) and against the inner walls of the chamber (8).

The biasing means (11) is in the first cavity (16) and is biased towards the first cavity (16) being expanded. The first cavity (16) is located in the peripheral portion of the chamber (8) distal to the entrance (5).

As the plunger (7) is forced into the chamber (8), the material (not shown) transfers through the orifice (13), driving back the movable wall (14) to expand the size of the second cavity (10) to accommodate the displaced material from the first cavity (16).

EXAMPLE 3

Figure 6A:
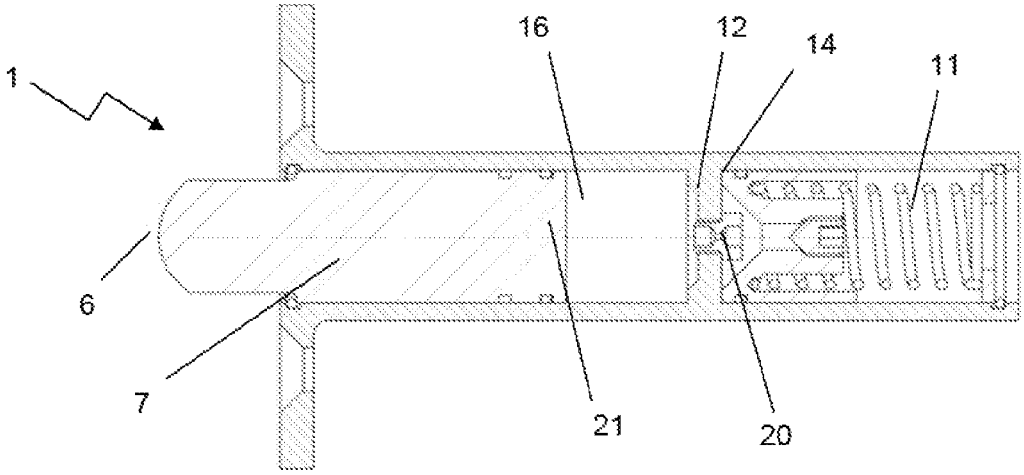
Figure 6B:
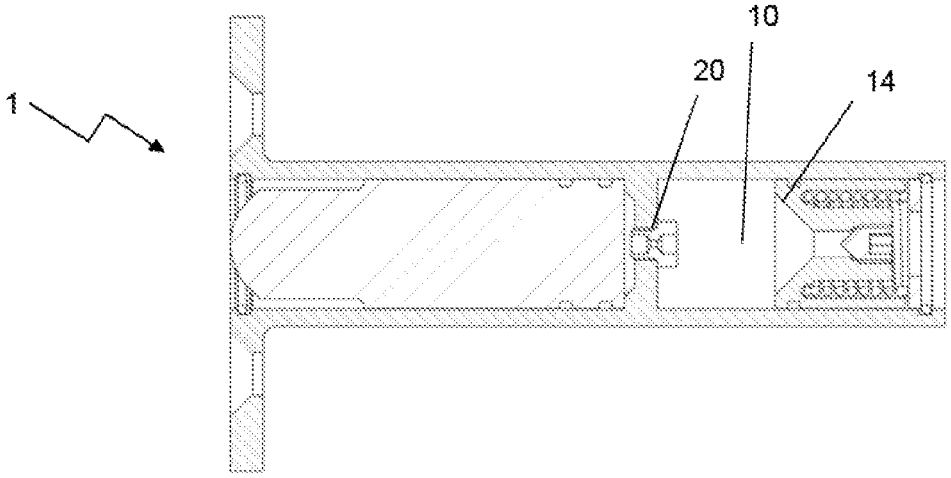

FIGS. 6A and 6B illustrate the device according the Embodiment 3 of the present invention in an expanded configuration and compacted configuration, respectively.

In Embodiment 3, the partition (12) is a fixed wall integrally built into the chamber (8), with the partition (12) including the orifice (13) including a nozzle (20).

The second cavity (10) is located on the opposite side to the partition (12) and away from the entrance (5). The second cavity (10) is defined by the inner walls of the chamber (8), the partition (12) and a movable wall (14) biased towards the partition (12) by the spring loaded coil (11).

The first cavity (16) is located on the opposite side of the partition (12) to the second cavity (10) and nearer to the entrance (5), and is defined by the inner walls of the chamber (8), the partition (12) housing the orifice (13) and by the front surface (21) of the plunger (7).

The plunger (7) is a solid cylindrical component that drives into the first cavity (16).

It should be appreciated that aspects of any one of embodiment 1-3 may be intermixed to provide even more embodiments which still fall within the scope of the invention, and provide particular advantages.

Aspects of the present invention have been described by way of example only and it should be appreciated that modifications and additions may be made thereto without departing from the scope thereof as defined in the appended claims.

What I claim is:

1. A door anti-slamming device, wherein the device includes a chamber with an entrance located at a first end;

wherein the chamber houses a plunger component with a tip configured to slidably move in and out of the entrance, therefore defining a compacted configuration and an extended configuration of the device, respectively;

wherein the device includes a biasing means configured to bias the device towards the extended configuration;

wherein the device includes a first cavity and a second cavity located within the chamber, and a fluid provided within the first and second cavities, and wherein a partition is located between the first and second cavities;

characterised in that the partition includes an orifice configured to control a transfer rate of the fluid between the first cavity and second cavity, wherein the device is configured to transition to the compacted configuration at a rate at least partially controlled by transfer of the fluid from the first cavity into the second cavity, and the partition remains in a fixed position with respect to the chamber when the device moves between the extended and compacted configurations, wherein the first cavity in the device is in direct contact with the plunger, and wherein the plunger is in direct contact with the first cavity, but is not in direct contact with the second cavity; and wherein the device comprises a cylindrical outer body, and wherein the partition is integrally formed with the outer body.

2. The device as claimed in claim 1, wherein the device is configured to be installed in a door frame.

3. The device as claimed in claim 1, wherein the device includes a separate impact plate intended to be positioned on an opposing surface.

4. The device as claimed in claim 1, wherein the entrance includes a stop.

5. The device as claimed in claim 1, wherein once a force is removed from the tip, the biasing means is configured to draw the fluid back from the second cavity into the first cavity through the orifice to return the device to the extended configuration.

6. The device as claimed in claim 1, wherein a) the second cavity is formed by internal walls of the chamber, the partition which includes the orifice, and a movable wall; and b) the movable wall is biased towards the partition through engagement with the biasing means, but the movable wall will retract from the partition to expand the second cavity upon pressure build up as a result of fluid passing through the orifice.

7. The device as claimed in claim 1, wherein:

the partition is a fixed wall integrally built into the chamber, with the partition including the orifice.

8. The device as claimed in claim 1, wherein the biasing means is a spring-loaded coil.

9. The device as claimed in claim 1, wherein the second cavity is configured to expand and contract.

10. The device as claimed in claim 9, wherein a fully expanded volume of the second cavity is substantial equal to a fully expanded volume of the first cavity.

11. The device as claimed in claim 1, wherein the device includes a plurality of seals such O-rings to allow the fluid to be effectively retained between the first and second cavities.

12. The device as claimed in claim 1, wherein the orifice is configured as a channel.

13. The device as claimed in claim 12, wherein the channel is between 0.01 mm and 10 mm in diameter.

14. The device as claimed in claim 1, wherein the orifice includes a nozzle.

15. The device as claimed in claim 1, wherein the orifice includes an adjustable diameter.

16. The device as claimed in claim 1, wherein only one orifice is present on the partition.

17. A use of a door anti-slamming device as claimed in claim 1 to stop or slow a door from slamming against a surface.

* * * * *